US010470487B2

(12) United States Patent
Gerardi et al.

(10) Patent No.: US 10,470,487 B2
(45) Date of Patent: Nov. 12, 2019

(54) SMOKE TREATMENT

(71) Applicant: R.J. Reynolds Tobacco Company, Winston-Salem, NC (US)

(72) Inventors: Anthony Richard Gerardi, Winston-Salem, NC (US); Jerry Wayne Marshall, Stokesdale, NC (US); Marvin Glenn Riddick, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 73 days.

(21) Appl. No.: 15/480,554

(22) Filed: Apr. 6, 2017

(65) Prior Publication Data

US 2018/0289054 A1 Oct. 11, 2018

(51) Int. Cl.

| | |
|---|---|
| ***A24B 15/30*** | (2006.01) |
| ***A24B 13/00*** | (2006.01) |
| ***A24B 3/12*** | (2006.01) |
| *A24B 1/02* | (2006.01) |

(52) U.S. Cl.

CPC ..... *A24B 15/302* (2013.01); *A24B 3/12* (2013.01); *A24B 13/00* (2013.01); *A24B 1/02* (2013.01)

(58) Field of Classification Search

None

See application file for complete search history.

(56) References Cited

U.S. PATENT DOCUMENTS

| | | | | |
|---|---|---|---|---|
| 2,927,188 | A | 3/1960 | Green | |
| 3,245,394 | A * | 4/1966 | Hawley | A23B 4/0523 126/59.5 |
| 3,364,936 | A * | 1/1968 | Axelrod | A24B 15/30 131/275 |
| 4,528,993 | A | 7/1985 | Sensabaugh, Jr. et al. | |
| 4,532,858 | A | 8/1985 | Hershfeld | |
| 4,607,479 | A | 8/1986 | Linden | |
| 4,631,899 | A | 12/1986 | Nielsen | |
| 4,657,765 | A | 4/1987 | Nicholson et al. | |
| 4,660,577 | A | 4/1987 | Sensabaugh et al. | |
| 5,167,244 | A | 12/1992 | Kjerstad | |
| 5,327,149 | A | 7/1994 | Kuffer | |
| 5,346,734 | A | 9/1994 | Wydick, Jr. | |
| 5,368,872 | A | 12/1994 | Hoffmann et al. | |

(Continued)

OTHER PUBLICATIONS

"CleanSmoke, Environmentally Friendly Smoking", Red Arrow Layman's Report, 2015, pp. 1-27. https://ec.europa.eu/environment/eco-innovation/projects/sites/eco-innovation-projects/files/projects/documents/cleansmoke - laymansreport-gb l.pdf.

(Continued)

*Primary Examiner* — Dennis R Cordray

(74) *Attorney, Agent, or Firm* — Womble Bond Dickinson (US) LLP

(57) ABSTRACT

A method of preparing a smoke-treated tobacco material is provided, the method including the steps of: (i) subjecting a tobacco material to smoke to give a smoke-treated tobacco material with modified taste characteristics; and (ii) incorporating the smoke-treated tobacco material into a smokeless tobacco product. The invention also provides a smokeless tobacco product incorporating a smoke-treated tobacco material. The smokeless tobacco product may be, for example, a moist snuff tobacco product.

18 Claims, 1 Drawing Sheet

(56) References Cited

U.S. PATENT DOCUMENTS

| | | | | |
|---|---|---|---|---|
| 5,910,330 | A | 6/1999 | Fessmann | |
| 6,162,516 | A | 12/2000 | Den | |
| 6,777,012 | B2 | 8/2004 | Olson et al. | |
| 6,846,177 | B1 | 1/2005 | Hutchens | |
| 6,895,974 | B2 | 5/2005 | Peele | |
| 6,936,293 | B2 | 8/2005 | Yamaoka et al. | |
| 7,001,635 | B2 | 2/2006 | Merritt, II et al. | |
| 7,025,066 | B2 | 4/2006 | Lawson et al. | |
| 7,650,892 | B1 * | 1/2010 | Groves | A24B 1/02 131/302 |
| 7,861,728 | B2 | 1/2011 | Holton, Jr. et al. | |
| 8,186,360 | B2 | 5/2012 | Marshall et al. | |
| 8,574,652 | B2 | 11/2013 | Ablett et al. | |
| 9,039,839 | B2 | 5/2015 | Beeson et al. | |
| 9,237,769 | B2 | 1/2016 | Mua et al. | |
| 9,277,757 | B2 | 3/2016 | Ablett et al. | |
| 9,408,403 | B2 | 8/2016 | Joly et al. | |
| 2004/0118422 | A1 | 6/2004 | Lundin et al. | |
| 2005/0061339 | A1 | 3/2005 | Hansson et al. | |
| 2007/0062549 | A1 | 3/2007 | Holton, Jr. et al. | |
| 2014/0299136 | A1 * | 10/2014 | Moldoveanu | A24B 15/183 131/290 |
| 2015/0101627 | A1 | 4/2015 | Marshall et al. | |
| 2017/0055565 | A1 | 3/2017 | Riddick et al. | |

OTHER PUBLICATIONS

"Meat Processing Technology, for Small to Medium Scale Producers" RAP Production 2007/20, 2007, pp. 1-36. www.fao.org/docrep/010/a1407e/A1407E00.htm.

De Roton et al. "Factors Influencing the Formation of Tobacco-Specific Nitrosamines in French Air-Cured Tobacco in Trials and at the Farm Level", Beitrage zur Tabakforschung International/Contributions to Tobacco Research, Jul. 2005, pp. 305-320, vol. 21 No. 6.

Nestor, et al. "Role of Oxides of Nitrogen in Tobacco-Specific Nitrosamine Formation in Flue-Cured Tobacco", Beitrage zur Tabakforschung International/Contributions to Tobacco Research, Nov. 2003, pp. 467-475, vol. 20 No. 7.

Staaf et al. "Formation of Tobacco-Specific Nitrosamines (TSNA) During Air-Curing: Conditions and Control", Beitrage zur Tabakforschung International/Contributions to Tobacco Research Jul. 2005, pp. 321-330, vol. 21 No. 6.

Miller et al., "Dark Fire-Cured Tobacco," *Tobaco: Production, Chemistry and Technology*, 1999, Blackwell Science Ltd., ISBN: 978-0-632-04791-8, pp. 164-181.

* cited by examiner

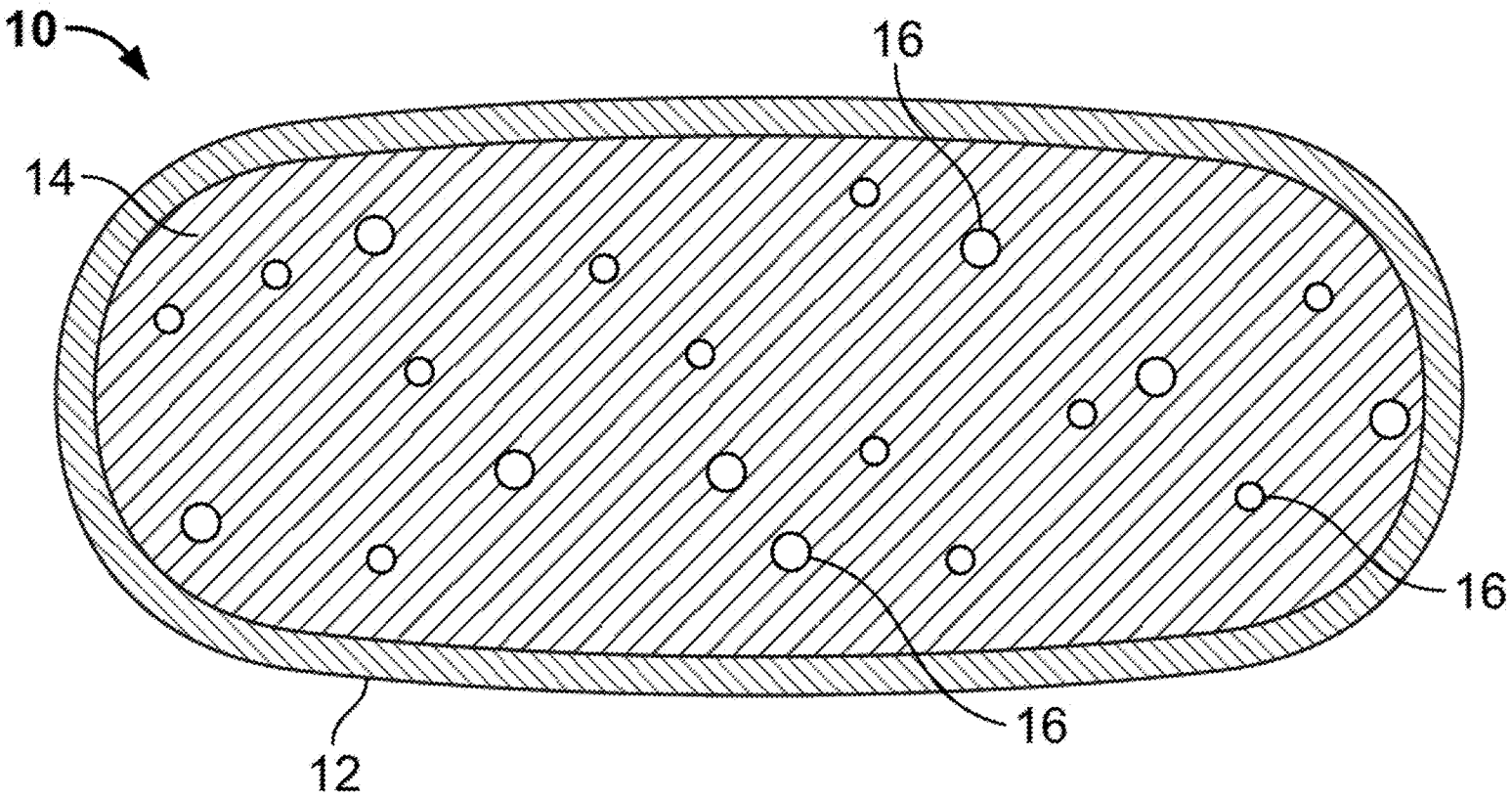
10
14
16
16
16
12

SMOKE TREATMENT

FIELD OF THE INVENTION

The present invention relates to products made or derived from tobacco, or that otherwise incorporate tobacco, and are intended for human consumption.

BACKGROUND OF THE INVENTION

Cigarettes, cigars and pipes are popular smoking articles that employ tobacco in various forms. Such smoking articles are used by heating or burning tobacco, and aerosol (e.g., smoke) is inhaled by the smoker. Tobacco also may be enjoyed in a so-called "smokeless" form. Particularly popular smokeless tobacco products are employed by inserting some form of processed tobacco or tobacco-containing formulation into the mouth of the user.

Various types of smokeless tobacco products are known. See for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; and U.S. Pat. No. 7,694,686 to Atchley et al.; US Pat. Pub. Nos. 2004/0020503 to Williams; 2005/0115580 to Quinter et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0173317 to Robinson et al.; 2008/0196730 to Engstrom et al.; 2008/0209586 to Neilsen et al.; 2008/0305216 to Crawford et al.; 2009/0065013 to Essen et al.; 2009/0293889 to Kumar et al.; 2010/0291245 to Gao et al; and 2011/0139164 to Mua et al.; PCT WO 04/095959 to Arnarp et al. and WO 2010/132444 to Atchley; each of which is incorporated herein by reference.

One type of smokeless tobacco product is referred to as "snuff." Representative types of moist snuff products, commonly referred to as "snus," are manufactured in Europe, particularly in Sweden, by or through companies such as Swedish Match AB, Fiedler & Lundgren AB, Gustavus AB, Skandinavisk Tobakskompagni A/S, and Rocker Production AB. Snus products available in the U.S.A. are marketed under the tradenames CAMEL Snus, CAMEL Orbs, CAMEL Strips and CAMEL Sticks by R. J. Reynolds Tobacco Company; GRIZZLY moist tobacco, KODIAK moist tobacco, LEVI GARRETT loose tobacco and TAYLOR'S PRIDE loose tobacco by American Snuff Company, LLC; KAYAK moist snuff and CHATTANOOGA CHEW chewing tobacco by Swisher International, Inc.; REDMAN chewing tobacco by Pinkerton Tobacco Co. LP; COPENHAGEN moist tobacco, COPENHAGEN Pouches, SKOAL Bandits, SKOAL Pouches, RED SEAL long cut and REVEL Mint Tobacco Packs by U.S. Smokeless Tobacco Company; and MARLBORO Snus and Taboka by Philip Morris USA. See also, for example, Bryzgalov et al., 1N1800 Life Cycle Assessment, Comparative Life Cycle Assessment of General Loose and Portion Snus (2005). In addition, certain quality standards associated with snus manufacture have been assembled as a so-called GothiaTek standard.

Through the years, various treatment methods and additives have been proposed for altering the overall character or nature of tobacco materials utilized in tobacco compositions. For example, additives or treatment processes are sometimes utilized in order to alter the chemistry or sensory properties of the tobacco material, or in the case of smokable tobacco materials, to alter the chemistry or sensory properties of mainstream smoke generated by smoking articles including the tobacco material. In some cases, a heat treatment process can be used to impart a desired color or visual character to the tobacco material, desired sensory properties to the tobacco material, or a desired physical nature or texture to the tobacco material.

It would be desirable in the art to provide further methods for altering the character and nature of tobacco (and tobacco compositions and formulations) useful in smoking articles or smokeless tobacco products.

SUMMARY OF THE INVENTION

The present invention provides a method of processing a tobacco material to modify the characteristics of the tobacco material, specifically to provide a flavorful smoke-treated tobacco material. The disclosure further provides smoke-treated tobacco material and products, e.g., tobacco products incorporating such smoke-treated tobacco material.

One aspect of the disclosure relates to a method of preparing a flavorful smokeless tobacco product, comprising: (i) subjecting a tobacco material to smoke to give a smoke-treated tobacco material with modified taste characteristics; and (ii) incorporating the smoke-treated tobacco material into a smokeless tobacco product. The smoke used in step (i) can vary in composition. For example, the method can involve producing the smoke from a wood material selected from oak, beech, alder, hickory, mesquite, acacia, ash, birch, pecan, walnut, almond, maple, olive, cottonwood, lilac, apple, crabapple, pear, cherry, plum, and combinations thereof. In some embodiments, the producing of smoke comprises burning or smoldering the wood material. In some embodiments, the producing of smoke comprises applying friction to the wood material. The subjecting step can, in certain embodiments, comprise atomizing or vaporizing liquid smoke. The subjecting step can be done, for example, at a temperature around 25° C. or below or at a temperature around 25° C. or above.

The tobacco material subjected to the disclosed methods can vary. In certain embodiments, the tobacco material comprises solid tobacco material selected from the group consisting of lamina and stems. In certain embodiments, the tobacco material comprises cured tobacco material. For example, the tobacco material in some embodiments comprises dark air cured tobacco.

Various additional steps can be conducted in combination with the referenced method steps. In certain embodiments, for example, the method further comprises curing the tobacco material, wherein the subjecting is done during the curing step. In some embodiments, the method further comprises fermenting the tobacco material, wherein the subjecting is done during the fermenting step. In some embodiments, the method further comprises mixing the smoke-treated tobacco material with a second tobacco material prior to the incorporating step. Such second tobacco material, in certain embodiments, is not a smoke-treated tobacco material. In some embodiments, the method further comprises grinding the smoke-treated tobacco material so as to provide it in particulate form.

The smoke-treated tobacco material, in some embodiments, has a lower concentration of benzo(a)pyrene than that present in a comparable amount of dark fire cured tobacco. The smokeless tobacco product provided according to the disclosed method can, for example, be in the form of moist snuff. In certain embodiments, the smokeless tobacco product comprises the smoke-treated tobacco material contained within a sealed pouch. In some embodiments, the smokeless tobacco product further comprises one or more additional components selected from the group consisting of flavorants, fillers, binders, pH adjusters, buffering agents, colorants, disintegration aids, antioxidants, humectants, and preservatives.

The present disclosure also provides a smokeless tobacco product prepared according to the methods disclosed herein. In another aspect, the disclosure provides a smokeless tobacco product comprising a smoke-treated tobacco material.

BRIEF DESCRIPTION OF THE DRAWINGS

FIG. 1 is a cross-sectional view of a smokeless tobacco product embodiment, taken across the width of the product, showing an outer pouch filled with tobacco material comprising smoke-treated tobacco material as disclosed herein and optional microcapsules disposed in the tobacco material.

DETAILED DESCRIPTION OF THE INVENTION

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water).

The invention provides a flavorful tobacco composition, smokeless tobacco products incorporating such flavorful tobacco compositions, and methods for preparing such flavorful tobacco compositions and for incorporating such compositions within smokeless tobacco products. Certain embodiments of the invention will be described with reference to FIG. 1 of the accompanying drawings, and these described embodiments involve snus-type products having an outer pouch and containing a treated tobacco material as described herein within the tobacco formulation. As explained in greater detail below, such embodiments are exemplary only, and the smokeless tobacco products of the present disclosure can include tobacco compositions in other forms Referring to FIG. 1, there is shown a first embodiment of a smokeless tobacco product 10. The tobacco product 10 includes a moisture-permeable container in the form of a pouch 12, which contains a solid tobacco filler material 14 comprising a "smoked tobacco material" of a type described herein. The smokeless tobacco product also may optionally comprise, in certain embodiments, a plurality of microcapsules 16 dispersed within the tobacco filler material 14, the microcapsules containing a component (e.g., a flavorant) such as described in greater detail below.

The tobacco product 10 is typically used by placing one pouch containing the tobacco formulation in the mouth of a human subject/user. During use, saliva in the mouth of the user causes some of the components of the tobacco formulation to pass through the water-permeable pouch and into the mouth of the user. The pouch preferably is not chewed or swallowed. The user is provided with tobacco flavor and satisfaction, and is not required to spit out any portion of the tobacco formulation. After about 10 minutes to about 60 minutes, typically about 15 minutes to about 45 minutes, of use/enjoyment, substantial amounts of the tobacco formulation and the contents of the optional microcapsules and have been ingested by the human subject, and the pouch may be removed from the mouth of the human subject for disposal.

As used herein, the terms "smoked," "smoke-treated," "smoking", "smoke treating," and "smoke treatment" refer to a process by which smoke (typically produced by heating/burning wood) is introduced into a substrate to modify the characteristics thereof. Smoking is common in the food industry, and is known as one of the oldest food preservation methods. It is used not only for food preservation, but also for altering the organoleptic characteristics of various foods. Different methods of such smoke treatment are known and are generally characterized by the method of smoke generation. For example, such methods include, but are not limited to, smoldering, using thermostated plates, liquid smoke vaporization, and friction smoking processes (as will be described in further detail herein below).

In certain embodiments, any such smoke treatment techniques are employed to produce smoke-treated tobacco. Such methods generally comprise using a tobacco material as the "substrate" referenced herein above (i.e., such that the tobacco material is treated with smoke). The type of tobacco treated according to these methods can vary and may be cured or uncured. The smoke-treated tobacco can, in some embodiments be employed within a tobacco composition in various types of smokeless tobacco products, including the solid tobacco filler material 14 of tobacco product 10.

In certain embodiments, tobaccos that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Passanda, Cubano, Jatin and Bezuki tobaccos), light air cured (e.g., North Wisconsin and Galpao tobaccos), Indian air cured, Red Russian and Rustica tobaccos, as well as various other rare or specialty tobaccos and various blends of any of the foregoing tobaccos. Descriptions of various types of tobaccos, growing practices and harvesting practices are set forth in *Tobacco Production, Chemistry and Technology*, Davis et al. (Eds.) (1999), which is incorporated herein by reference. Various representative other types of plants from the *Nicotiana* species are set forth in Goodspeed, *The Genus Nicotiana*, (Chonica Botanica) (1954); U.S. Pat. No. 4,660,577 to Sensabaugh, Jr. et al.; U.S. Pat. No. 5,387,416 to White et al., U.S. Pat. No. 7,025,066 to Lawson et al.; U.S. Pat. No. 7,798,153 to Lawrence, Jr. and U.S. Pat. No. 8,186,360 to Marshall et al.; each of which is incorporated herein by reference. Exemplary *Nicotiana* species include *N. tabacum, N. rustica, N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata, N.×sanderae, N. africana, N. amplexicaulis, N. benavidesii, N. bonariensis, N. debneyi, N. longiflora, N. maritina, N. megalosiphon, N. occidentalis, N. paniculata, N. plumbag-*

*inifolia, N. raimondii, N. rosulata, N. simulans, N. stocktonii, N. suaveolens, N. umbratica, N. velutina, N. wigandioides, N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis subsp. Hersperis, N. pauciflora, N. petunioides, N. quadrivalvis, N. repanda, N. rotundifolia, N. solanifolia*, and *N. spegazzinii.*

*Nicotiana* species from which tobacco can be obtained for treatment as disclosed herein can be derived using genetic-modification or crossbreeding techniques (e.g., tobacco plants can be genetically engineered or crossbred to increase or decrease production of components, characteristics or attributes). See, for example, the types of genetic modifications of plants set forth in U.S. Pat. No. 5,539,093 to Fitzmaurice et al.; U.S. Pat. No. 5,668,295 to Wahab et al.; U.S. Pat. No. 5,705,624 to Fitzmaurice et al.; U.S. Pat. No. 5,844,119 to Weigl; U.S. Pat. No. 6,730,832 to Dominguez et al.; U.S. Pat. No. 7,173,170 to Liu et al.; U.S. Pat. No. 7,208,659 to Colliver et al. and U.S. Pat. No. 7,230,160 to Benning et al.; US Patent Appl. Pub. No. 2006/0236434 to Conkling et al.; and PCT WO2008/103935 to Nielsen et al. See, also, the types of tobaccos that are set forth in U.S. Pat. No. 4,660,577 to Sensabaugh, Jr. et al.; U.S. Pat. No. 5,387,416 to White et al.; and U.S. Pat. No. 6,730,832 to Dominguez et al., each of which is incorporated herein by reference.

Most preferably, the smoke-treated tobacco materials incorporated within tobacco compositions for inclusion within smokeless tobacco products as disclosed herein are those that have been appropriately cured and/or aged, although it is noted that such curing and aging can be conducted during or before the referenced smoke treatment. In certain embodiments, the smoke treatment disclosed herein is conducted substantially simultaneously as curing. For example, a tobacco material can be subjected to both curing and smoke treatment conditions at the same time, such that the material is smoke treated and cured in a single process. In one particular embodiment, smoke can be generated as described herein and directed into a tobacco curing barn to conduct curing and smoke treatment substantially simultaneously.

In one preferred embodiment, the tobacco material subjected to smoke treatment as disclosed herein is dark air cured tobacco. Preferred techniques and conditions for curing flue-cured tobacco are set forth in Nestor et al., Beitrage Tabakforsch. Int., 20 (2003) 467-475 and U.S. Pat. No. 6,895,974 to Peele, which are incorporated herein by reference. Representative techniques and conditions for air curing tobacco are set forth in Roton et al., Beitrage Tabakforsch. Int., 21 (2005) 305-320 and Staaf et al., Beitrage Tabakforsch. Int., 21 (2005) 321-330, which are incorporated herein by reference. Certain types of unusual or rare tobaccos can be sun cured. Manners and methods for improving the smoking quality of Oriental tobaccos are set forth in U.S. Pat. No. 7,025,066 to Lawson et al., which is incorporated herein by reference. Representative Oriental tobaccos include katerini, prelip, komotini, xanthi and yambol tobaccos. Tobacco compositions including dark air cured tobacco are set forth in U.S. Pat. No. 8,186,360 to Marshall et al., which is incorporated herein by reference. See also, types of tobacco as set forth, for example, in U.S. Pat. No. 9,039,839 to Beeson et al., which is incorporated herein by reference.

The *Nicotiana* species can, in some embodiments, be selected for the content of various compounds that are present therein. For example, plants can be selected on the basis that those plants produce relatively high quantities of one or more of the compounds desired to be isolated therefrom. In certain embodiments, plants of the *Nicotiana* species (e.g., *Galpao commun* tobacco) are specifically grown for their abundance of leaf surface compounds. Tobacco plants can be grown in greenhouses, growth chambers, or outdoors in fields, or grown hydroponically.

Various parts or portions of the plant of the *Nicotiana* species can be smoke-treated for inclusion within a tobacco composition according to the disclosed methods. For example, virtually all of the plant (e.g., the whole plant) can be harvested, and employed as such. Alternatively, various parts or pieces of the plant can be harvested or separated for further use after harvest. For example, the flower, leaves, stem, stalk, roots, seeds, and various combinations thereof, can be isolated for further use or treatment. In preferred embodiments, the treated tobacco material comprises tobacco leaf (lamina).

The post-harvest processing of the plant or portion thereof can vary. After harvest, the plant, or portion thereof, can be smoke-treated in a green form (e.g., the plant or portion thereof can be used without being subjected to any curing process). For example, the plant or portion thereof can be treated without being subjected to significant storage, handling or processing conditions. In certain situations, it is advantageous for the plant or portion thereof be treated virtually immediately after harvest. Alternatively, for example, a plant or portion thereof in green form can be refrigerated or frozen for later treatment, freeze dried, subjected to irradiation, yellowed, dried, cured (e.g., using air drying techniques or techniques that employ application of heat), heated or cooked (e.g., roasted, fried or boiled), or otherwise subjected to storage or treatment for later treatment according to the methods disclosed herein.

The harvested plant or portion thereof can be physically processed before or after the disclosed smoke treatment. The plant or portion thereof can be separated into individual parts or pieces (e.g., the leaves can be removed from the stems, and/or the stems and leaves can be removed from the stalk). The harvested plant or individual parts or pieces can be further subdivided into parts or pieces (e.g., the leaves can be shredded, cut, comminuted, pulverized, milled or ground into pieces or parts that can be characterized as filler-type pieces, granules, particulates or fine powders). The plant, or parts thereof, can be subjected to external forces or pressure (e.g., by being pressed or subjected to roll treatment). When carrying out such processing conditions, the plant or portion thereof can have a moisture content that approximates its natural moisture content (e.g., its moisture content immediately upon harvest), a moisture content achieved by adding moisture to the plant or portion thereof, or a moisture content that results from the drying of the plant or portion thereof. For example, powdered, pulverized, ground or milled pieces of plants or portions thereof can have moisture contents of less than about 25 weight percent, often less than about 20 weight percent, and frequently less than about 15 weight percent.

Although the tobacco material to be treated as disclosed herein is typically directly subjected to smoke treatment (without significant alteration except for optional curing, aging, and/or physical processing), in some embodiments, it can be extracted prior to smoke treatment. For example, a tobacco material can be extracted with a suitable liquid so as to provide a tobacco extract and a tobacco pulp and the tobacco pulp can be subjected to the smoke treatment disclosed herein. Exemplary extraction methods are known, e.g., as described in U.S. Pat. No. 9,039,839 to Beeson et al, which is incorporated herein by reference; see also other exemplary techniques for extracting components of tobacco as described in U.S. Pat. No. 4,144,895 to Fiore; U.S. Pat. No. 4,150,677 to Osborne, Jr. et al.; U.S. Pat. No. 4,267,847 to Reid; U.S. Pat. No. 4,289,147 to Wildman et al.; U.S. Pat. No. 4,351,346 to Brummer et al.; U.S. Pat. No. 4,359,059 to Brummer et al.; U.S. Pat. No. 4,506,682 to Muller; U.S. Pat. No. 4,589,428 to Keritsis; U.S. Pat. No. 4,605,016 to Soga et al.; U.S. Pat. No. 4,716,911 to Poulose et al.; U.S. Pat. No. 4,727,889 to Niven, Jr. et al.; U.S. Pat. No. 4,887,618 to Bernasek et al.; U.S. Pat. No. 4,941,484 to Clapp et al.; U.S. Pat. No. 4,967,771 to Fagg et al.; U.S. Pat. No. 4,986,286 to Roberts et al.; U.S. Pat. No. 5,005,593 to Fagg et al.; U.S. Pat. No. 5,018,540 to Grubbs et al.; U.S. Pat. No. 5,060,669 to White et al.; U.S. Pat. No. 5,065,775 to Fagg; U.S. Pat. No. 5,074,319 to White et al.; U.S. Pat. No. 5,099,862 to White et al.; U.S. Pat. No. 5,121,757 to White et al.; U.S. Pat. No. 5,131,414 to Fagg; U.S. Pat. No. 5,131,415 to Munoz et al.; U.S. Pat. No. 5,148,819 to Fagg; U.S. Pat. No. 5,197,494 to Kramer; U.S. Pat. No. 5,230,354 to Smith et al.; U.S. Pat. No. 5,234,008 to Fagg; U.S. Pat. No. 5,243,999 to Smith; U.S. Pat. No. 5,301,694 to Raymond et al.; U.S. Pat. No. 5,318,050 to Gonzalez-Parra et al.; U.S. Pat. No. 5,343,879 to Teague; U.S. Pat. No. 5,360,022 to Newton; U.S. Pat. No. 5,435,325 to Clapp et al.; U.S. Pat. No. 5,445,169 to Brinkley et al.; U.S. Pat. No. 6,131,584 to Lauterbach; U.S. Pat. No. 6,298,859 to Kierulff et al.; U.S. Pat. No. 6,772,767 to Mua et al.; and U.S. Pat. No. 7,337,782 to Thompson, all of which are incorporated by reference herein.

Methods for providing tobacco in smoked form for inclusion within a smokeless tobacco product as outlined herein can vary. Generally, any method for endowing the tobacco with smoky characteristics can be employed. Various methods are known for smoking foods (e.g., for preservation, tenderizing, and/or flavor enhancement) and include, but are not limited to, methods as disclosed in U.S. Pat. No. 9,277,757 to Ablett et al. (methods for smoke-infusing cheese), U.S. Pat. No. 8,574,652 to Ablett et al. (methods for smoke-infusing crustaceans or mollusks or fish), U.S. Pat. No. 6,777,012 to Olson et al. (methods for seafood preservation), U.S. Pat. No. 7,001,635 to Merritt II et al. (method for improving smoky color of an encased food product, e.g., sausage), U.S. Pat. No. 6,936,293 to Yamaoka et al. (method for preserving tuna using smoke injection needles), U.S. Pat. No. 5,910,330 to Fessman (a method for smoking foodstuffs in a treatment chamber), U.S. Pat. No. 5,368,872 to Davis (method and apparatus for pressure and vacuum smoking food), U.S. Pat. No. 4,657,765 (method for imparting smoke color and flavor to food), and U.S. Pat. No. 4,532,858 to Hershfeld (method of showering edible products with liquid smoke), all of which are incorporated herein by reference.

The smoke source can be vary and is typically a burning or smoldering cellulosic material such as wood. Exemplary woods that can be burned to provide smoke that can endow a material (here, a tobacco material) with smoky characteristics include, but are not limited to, oak, beech, alder, hickory, mesquite, acacia, ash, birch, chestnut, pecan, walnut, almond, maple, olive, cottonwood, lilac, fruit tree woods (e.g., apple, crabapple, pear, cherry, apricot, peach, plum, fig, and the like), and combinations of any two or more of the foregoing. Other materials that can be burned/smoldered to provide smoky characteristics can be employed (in place of or in combination with the woods), such as corncobs, peat, dried dung, grape vines, coconut shells, dried citrus peels, nut shells, and combinations of any two or more of the foregoing. The selection of smoke source can affect the amount and type of flavor introduced to the tobacco material by smoke treatment. For example, alder and fruit tree woods typically provide a sweet and less strong flavor than, e.g., birch, hickory, and mesquite. The smoke source can be, e.g., in the form of logs, chips, chunks, pellets, bisquettes, dust, or a combination thereof. In some embodiments, the form of the smoke source used is dependent upon the smoker setup (e.g., wood pellets are typically used within a pellet smoker).

Advantageously, the smoke source is in substantially dried form (e.g., comprising less than about 15% water, less than about 10% water, or less than about 5% water by weight). In some embodiments, the smoke treatment involves "dry" smoking, in which no additional moisture is added during the smoke treatment. In other embodiments, the smoke treatment involves "wet" smoking, in which water (in liquid or steam form) is added at one or more times during the treatment.

In some embodiments, the cellulosic material (e.g., wood) comprises further components. For example, in some embodiments, the cellulosic material can include an antimicrobial agent (e.g., which can be coated on at least a portion of the exterior of the smoke source or otherwise associated with the smoke source). The optional inclusion of an antimicrobial agent can provide an environment that, when the smoke source is burned/smoldered, is less conducive to the formation of undesirable bacteria. For example, it may provide an environment that is less conducive to the formation of denitrifying bacteria by blocking the formation of nitric oxide, resulting in a decreased potential for undesirable nitrosamine formation (particularly where the smoke treatment is conducted within a closed chamber).

Smoke treatment of tobacco can be done in under "cold" conditions (referred to as "cold-smoking") or hot conditions (referred to as "hot-smoking"). The designation of "cold" with reference to smoke treatment generally describes smoking techniques which are conducted at or below ambient temperature, e.g., at temperatures of 25° C. or below. The designation of "hot" with reference to smoke treatment generally describes smoking techniques which are conducted above 25° C. The time for which a tobacco material is treated via smoke treatment can vary and is typically that period of time sufficient to modify the taste of the tobacco material (e.g., to endow the material with smoky characteristics). It is noted that the time period can depend, e.g., on the type/form of tobacco treated, the type of wood, and the specific smoke treatment technique (and associated variables). An effective time period, in some embodiments, can be evaluated by monitoring the pH of the tobacco material during smoke treatment, e.g., according to methods outlined in U.S. Pat. No. 9,408,403 to Joly et al., which is incorporated herein by reference.

Smoke is generated from such sources in various ways. In some embodiments, smoke is produced by burning or smoldering the wood or other cellulosic material, e.g., in a typical smoker setup (comprising, e.g., a first compartment in which the smoke source is burned/smoldered to produce smoke, and a second compartment (typically a closed chamber), into which the smoke can be directed so as to contact the substrate (here, tobacco)). Burning, as the name indicates, refers to burning the smoke source such that a flame is created (e.g., at a temperature of between about 400° C. and 800° C.). Smoldering typically results from starving the smoke source of oxygen such that a flame is not present. In some such embodiments, humidity may be beneficial in the compartment in which the tobacco material is contacted with the smoke and may be provided, e.g., by applying a liquid (e.g., water) to the tobacco material and/or to the atmosphere in the compartment (e.g., by injecting steam or by keeping a pan containing water in the compartment).

The apparatus in which tobacco is smoked can vary and in certain embodiments, the apparatus is an indirect smoking apparatus. One particular embodiment employs a smoke scrubber to filter certain undesirable smoke particulate before the smoke is brought into contact with the substrate (tobacco). Such a scrubber can be any component suitable to achieve this purpose, ranging, e.g., from a spray of water brought into contact with the smoke to a sophisticated filtration system through which the smoke passes (e.g., comprising a filter with pores on the micron scale). In some embodiments, the apparatus provides control in the compartment in which the smoke is contacted with the tobacco, e.g., over such parameters as temperature, humidity, smoke generation, and/or ventilation (intake and exit damper control) and the like. In some embodiments, this compartment is equipped with exhaust fans, which can help facilitate the drawing of smoke through the tobacco material, which may assist in avoiding anaerobic conditions during the course of smoking.

In some embodiments, at least a portion of the process described herein (e.g., contacting the tobacco material with smoke) is conducted within a smokehouse. As referenced herein above, in one particular embodiment, tobacco is smoked and cured substantially simultaneously, by generating smoke and directing the smoke into, e.g., a tobacco curing barn. In some such embodiments, the tobacco curing barn is a barn as typically employed for flue-curing barns, with an integrated control system for controlling set points for the various parameters noted above.

In some embodiments, a friction smoking system is employed to provide the smoke. Such friction smoking systems produce smoke via friction, commonly between wood and/or another smoke-producing cellulosic material and a second surface. In one particular embodiment, a wooden component is pressed onto a fast rotating friction wheel to produce smoke. Variables such as pressure between the wood component and the friction wheel, the speed at which the friction wheel is rotated, the friction interval (period of time for which the wheel is rotated) can be modified to adjust the amount of smoke generation. The friction wheel can, in some embodiments, be operated for a short period of time (e.g., under a minute), followed by an interval of no operation (e.g., between about 10 seconds and 3 minutes), so as to avoid igniting the wood component. In some embodiments, heat can be applied to the friction wheel, e.g., up to about 400° C.

In further embodiments, thermostated plates can be used to produce smoke. Generally, thermostated plates are based on the pyrolysis of wood or other cellulosic sources as referenced herein above, which are placed onto thermostated plates. The wood is removed from the thermostated plates after a given period of time, and the smoke produced thereby is then brought into contact with the substrate to be smoke-treated. In another embodiment, a pellet smoker is used to produce smoke.

In some embodiments, smoke for the smoke treatment is generated by steam injection into cellulosic material (e.g., wood chips or sawdust). In such embodiments, the injection of steam results in thermal distraction of the cellulosic material (e.g., wood) and smoke is thereby generated. In this method of smoke production, smoke generation temperature can be controlled by choosing the steam temperature. Impurities in the smoke from particles of tar or ash produced by this method are typically minimal.

In some embodiments, liquid smoke vaporization/atomization is used to produce smoke for the smoke treatment. The liquid smoke generally comprises a purified smoke condensate (condensed smoke flavoring) that has been treated to remove one or more components therefrom. Methods for providing liquid smoke are generally known. For example, smoke can be produced and a pre-purified primary smoke product is produced therefrom by passing the as-produced smoke through water and collecting the condensed smoke component-containing liquid. This liquid can be further purified, e.g., by filtrations (providing liquid smoke). An exemplary technique for purification of smoke in this manner is provided, e.g., at https://ec.europa.eu/environment/eco-innovation/projects/sites/eco-innovation-projects/files/projects/documents/cleansmoke_-_laymansreport-gb_1.pdf, which is incorporated by reference herein in its entirety. Any of the types of smoke (e.g., produced from various sources) disclosed herein above can be provided in the form of liquid smoke and used in such embodiments accordingly.

Vaporization/atomization of liquid smoke can be conducted in varying manners, e.g., by using compressed air. In some embodiments, the tobacco material is introduced into a compartment and the liquid smoke is atomized into the compartment. In some embodiments, heat may be applied before, during, and/or after this atomization, and the atomization process can be conducted once before the tobacco material is removed from the compartment or can be repeated two or more times. Within the compartment, the atomized liquid smoke can optionally be moved (e.g., circulated) or can be allowed to sit/"dwell" on the tobacco material (or both techniques can be used in succession). In one embodiment, the tobacco material is introduced into an oven to be dried (by the addition of heat), the heat is turned off, liquid smoke is atomized into the oven and allowed to "dwell" on the tobacco, and then the heat is turned on again to dry the smoke-treated tobacco material.

The use of a liquid smoke vaporization/atomization technique is advantageous in some embodiments, as the resulting smoke is typically characterized by a lower content of certain undesirable compounds (e.g., tar, ash and polycyclic aromatic hydrocarbons) than unpurified (directly produced) smoke. As such, tobacco material treated by purified smoke (e.g., in the form of smoke vaporized or atomized from a liquid smoke product) may, in certain embodiments, contain lesser amounts of such undesirable compounds than tobacco material treated via direct smoking methods (i.e., by bringing the tobacco into contact with smoke being directly produced from burning wood, smoldering wood, or friction between wood and a secondary surface). As such, in certain preferred embodiments, any one or more of these methods can be used to produce liquid smoke as disclosed herein, and that liquid smoke can then be used to smoke treat the tobacco.

In one embodiment, the smoke treatment is conducted during fermentation of a tobacco material, e.g., by injecting smoke (e.g., by liquid smoke vaporization/atomization) into a bioreactor. Exemplary fermentation processes that can be used in combination with the disclosed smoke treatment techniques are descried, e.g., in U.S. Pat. No. 2,927,188 to Brenik et al.; U.S. Pat. No. 4,660,577 to Sensabaugh et al.; U.S. Pat. No. 4,528,993 to Sensabaugh et al., and U.S. Pat. No. 5,327,149 to Roth et al., which are incorporated herein by reference. By combining the smoke treatment and fermentation processes, a tobacco material for use, e.g., in fermented moist snuff products can advantageously be produced. The fermented moist snuff product can, as generally described herein for smoke-treated tobacco materials, comprise sufficient levels of sensory compounds such as phenols to provide a desired flavor and can, in some embodiments, have lower levels of, e.g., benzo[a]pyrene and tobacco-specific nitrosamines than conventional moist snuff (e.g., utilizing a blend of dark fire cured and dark air cured tobaccos).

The smoke produced and used to treat tobacco material according to the present methods (whether used directly or purified prior to such contact) can vary in aroma and flavor and thus, the resulting smoke-treated tobacco material can vary in aroma and flavor. The resulting smoke-treated tobacco material can vary in flavor, e.g., including such smoke-provided characteristics as smoky, spicy, sweet, and/or vanilla-like. In some embodiments, smoke-treated tobacco exhibits sensory properties characteristic of typical dark fire cured tobacco. Compositionally, the smoke produced by the smoke source can, as such, further vary in the amounts of types of compounds contained therein. Smoke generally includes various compounds, the majority of which can be classified as phenols, carbonyls, and acids. Typically, many of the flavor-producing components are phenolic, furannic, and enolone compounds. Exemplary compounds that can be found in smoke (and found in tobacco materials subjected to such smoke) include, but are not limited to, furfural, furfuryl alcohol, 5-methylfurfural, 2-methyl-2-cyclopenten-1-one, 2-hydroxyl-3-methyl-2-cyclopenten-1-one, 2,3-dimethyl-2-cyclopeneten-1-one, phenol, 2,6-dimethyphenol, o-cresol, p-cresol, guaiacol, guaiacol derivatives (e.g., 4-methylguaiacol and 4-vinylguaiacol), isoeugenol isomers, 2-acteylfuran, hexadienal, syringol, 4-allyl syringol, 4-methylpyridine, and 2,6-dimethylpyridine. As such, a tobacco material that is smoke-treated according to the methods disclosed herein typically comprises higher concentrations of one or more of the foregoing compound classes and/or specific compounds than a non-smoke-treated tobacco material. The specific smoking technique employed and the parameters of such technique (e.g., time and temperature) can affect the types and amounts of such compounds present in the smoke-treated tobacco material, as disclosed, e.g., in http://www.fao.org/3/a-i0884b/i0884b02b.pdf, which is incorporated herein by reference in its entirety.

Advantageously, the tobacco material is smoke-treated so as to provide a treated tobacco material having relatively low levels of certain undesirable compounds, e.g., poly aromatic hydrocarbons (e.g., dibenzo(a,i)pyrene, dibenzo(a,h)pyrene, dibenzo(a,e)pyrene, dibenzo(a,l)pyrene, dibenzo(a,h)pyrene, indeno(1,2,3-cd)pyrene, benzo(g,h,i)perylene, benzo(a)pyrene, benzo(k)fluoranthene, benzo(j)fluoranthene, benzo(b)fluoranthene, 5-methyl chrysene, chrysene, cyclopenta(c,d)pyrene, benzo(a)anthracene, pyrene, fluoranthene, anthracene, phenanthrene, and fluorene). Advantageously, the content of such compounds is well below the maximum limit for smoked food products. In some embodiments, the content of such compounds satisfy the Gothiatek® standards. In some embodiments, the content of benzo[a]pyrene is about 5 ppb (ng/g) or below, e.g., about 3 ppb or below, about 2 ppb or below, about 1.5 ppb or below, about 1.25 ppb or below, or about 1 ppb or below. The content of tobacco-specific nitrosamines (TSNAs), including N'-nitrosonornicotine (NNN), (4-methylnitrosamino)-1-(3-pyridyl)-1-butanone (NNK), N'-nitrosoanatabine (NAT), and N'-nitrosoanabasine (NAB) in smoke-treated materials as disclosed herein is also preferably low, e.g., below the limits of the Gothiatek® standards. In some embodiments, the content of TSNAs is less than about 1000 ppb or less than about 500 ppb, less than about 400 ppb, less than about 300 ppb or less than about 200 ppb. In some cases, the TSNA level is even lower, e.g., less than about 100 ppb or less than about 50 ppb.

The tobacco material treated according to any one of the methods disclosed herein to endow it with "smoky" characteristics is then typically incorporated into a smokeless tobacco product. The smoke-treated tobacco material of the invention can be used as a component of a smokeless tobacco composition, such as loose moist snuff, loose dry snuff, chewing tobacco, pelletized tobacco pieces, extruded or formed tobacco strips, pieces, rods, or sticks, finely divided ground powders, finely divided or milled agglomerates of powdered pieces and components, flake-like pieces, molded processed tobacco pieces, pieces of tobacco-containing gum, rolls of tape-like films, readily water-dissolvable or water-dispersible films or strips, or capsule-like materials. Although not limited thereto, in some embodiments, smoke-treated tobacco as disclosed herein can be used to substitute all or a part of the dark fire cured tobacco typically employed in certain smokeless tobacco products.

The tobacco incorporated within the referenced tobacco product (e.g., as a component of solid tobacco filler material 14 in tobacco product 10 of FIG. 1) may comprise varying percentages of smoke-treated tobacco as disclosed herein, e.g., at least about 10% by weight, at least about 50% by weight, at least about 80% by weight, at least about 90% by weight, or substantially all of the tobacco within a given composition can be smoke-treated as disclosed herein. Where non-smoke-treated tobacco is incorporated within the composition, it can be any of the types disclosed herein and is advantageously cured and/or aged.

Tobacco compositions intended to be used in a smokeless form such as that in FIG. 1 may incorporate a single type of tobacco (e.g., in a so-called "straight grade" form). For example, the tobacco within a tobacco composition may be composed solely of flue-cured tobacco (e.g., all of the tobacco may be composed, or derived from, either flue-cured tobacco lamina or a mixture of flue-cured tobacco lamina and flue-cured tobacco stem). The tobacco within such a tobacco composition also may have a so-called "blended" form. For example, the tobacco within a tobacco composition of the present invention may include a mixture of parts or pieces of flue-cured, burley (e.g., Malawi burley tobacco) and Oriental tobaccos (e.g., as tobacco composed of, or derived from, tobacco lamina, or a mixture of tobacco lamina and tobacco stem). For example, a representative blend may incorporate about 30 to about 70 parts burley tobacco (e.g., lamina, or lamina and stem), and about 30 to about 70 parts flue cured tobacco (e.g., stem, lamina, or lamina and stem) on a dry weight basis. Other exemplary tobacco blends incorporate about 75 parts flue-cured tobacco, about 15 parts burley tobacco, and about 10 parts Oriental tobacco; or about 65 parts flue-cured tobacco, about 25 parts burley tobacco, and about 10 parts Oriental tobacco; or about 65 parts flue-cured tobacco, about 10 parts burley tobacco, and about 25 parts Oriental tobacco; on a dry weight basis. Other exemplary tobacco blends incorporate about 20 to about 30 parts Oriental tobacco and about 70 to about 80 parts flue-cured tobacco. Such blends can comprise varying amounts of smoke-treated tobacco as disclosed herein, comprising one or more of the tobacco types included within the blend.

The tobacco compositions disclosed herein (comprising tobacco that has been smoke-treated according to the methods disclosed herein) can have the form of processed tobacco parts or pieces, cured and aged tobacco in essentially natural lamina and/or stem form, a tobacco extract, extracted tobacco pulp (e.g., using water as a solvent), or a mixture of the foregoing (e.g., a mixture that combines extracted tobacco pulp with granulated cured and aged natural tobacco lamina). The tobacco that is used for the tobacco product most preferably includes tobacco lamina, or a tobacco lamina and stem mixture (of which at least a portion is smoke-treated). Portions of the tobaccos within the tobacco product may have processed forms, such as processed tobacco stems (e.g., cut-rolled stems, cut-rolled-expanded stems or cut-puffed stems), or volume expanded tobacco (e.g., puffed tobacco, such as dry ice expanded tobacco (DIET)). See, for example, the tobacco expansion processes set forth in U.S. Pat. No. 4,340,073 to de la Burde et al.; U.S. Pat. No. 5,259,403 to Guy et al.; and U.S. Pat. No. 5,908,032 to Poindexter, et al.; and U.S. Pat. No. 7,556,047 to Poindexter, et al., all of which are incorporated by reference. In addition, the tobacco product optionally may incorporate tobacco that has been fermented. See, also, the types of tobacco processing techniques set forth in PCT WO2005/063060 to Atchley et al., which is incorporated herein by reference.

The tobacco material used in the smokeless tobacco products of the present invention is typically provided in a shredded, ground, granulated, fine particulate, or powder form. Most preferably, the tobacco is employed in the form of parts or pieces that have an average particle size less than that of the parts or pieces of shredded tobacco used in so-called "fine cut" tobacco products. Typically, the very finely divided tobacco particles or pieces are sized to pass through a screen of about 18 or 16 Tyler mesh, generally are sized to pass a screen of about 20 Tyler mesh, often are sized to pass through a screen of about 50 Tyler mesh, frequently are sized to pass through a screen of about 60 Tyler mesh, may even be sized to pass through a screen of 100 Tyler mesh, and further may be sized so as to pass through a screen of 200 Tyler mesh. If desired, air classification equipment may be used to ensure that small sized tobacco particles of the desired sizes, or range of sizes, may be collected. In one embodiment, the tobacco material is in particulate form sized to pass through an 18 or 16 Tyler mesh, but not through a 60 Tyler mesh. If desired, differently sized pieces of granulated tobacco may be mixed together. Typically, the very finely divided tobacco particles or pieces suitable for snus products have a particle size greater than −8 Tyler mesh, often −8 to +100 Tyler mesh, frequently −16 to +60 Tyler mesh. In certain embodiments, the tobacco is provided with an average particle size of about 0.3 to about 2 mm, more often about 0.5 to about 1.5 mm, and most often about 0.75 to about 1.25 mm (e.g., about 1 mm).

The manner by which the tobacco is provided in a finely divided or powder type of form may vary. Preferably, tobacco parts or pieces are comminuted, ground or pulverized into a powder type of form using equipment and techniques for grinding, milling, or the like. Most preferably, the tobacco is relatively dry in form during grinding or milling, using equipment such as hammer mills, cutter heads, air control mills, or the like. For example, tobacco parts or pieces may be ground or milled when the moisture content thereof is less than about 15 weight percent to less than about 5 weight percent. The tobacco material can be processed to provide it in the desired form before and/or after being subjected to the smoke treatment process described herein.

The tobacco materials discussed in the present invention can be treated and/or processed in other ways before, after, or during the smoke treatment. For example, if desired, the tobacco materials can be irradiated, pasteurized, or otherwise subjected to controlled heat treatment. Such treatment processes are detailed, for example, in U.S. Pat. No. 8,061,362 to Mua et al., which is incorporated herein by reference. In certain embodiments, tobacco materials can be treated with water and an additive capable of inhibiting reaction of asparagine to form acrylamide upon heating of the tobacco material (e.g., an additive selected from the group consisting of lysine, glycine, histidine, alanine, methionine, glutamic acid, aspartic acid, proline, phenylalanine, valine, arginine, compositions incorporating di- and trivalent cations, asparaginase, certain non-reducing saccharides, certain reducing agents, phenolic compounds, certain compounds having at least one free thiol group or functionality, oxidizing agents, oxidation catalysts, natural plant extracts (e.g., rosemary extract), and combinations thereof), and combinations thereof. See, for example, the types of treatment processes described in U.S. Pat. Nos. 8,434,496, 8,944,072, and 8,991,403 to Chen et al., which are all incorporated herein by reference. In certain embodiments, this type of treatment is useful where the original tobacco material is subjected to heat in the processes previously described.

The smoke-treated tobacco material can be incorporated within a smokeless tobacco product according to the present invention. Depending on the type of tobacco product being processed, the tobacco product can include one or more additional components in addition to the smoke-treated tobacco material as described above. For example, the smoke-treated tobacco material can be processed, blended, formulated, combined and/or mixed with other materials or ingredients, such as other tobacco materials or flavorants, fillers, binders, pH adjusters, buffering agents, salts, sweeteners, colorants, oral care additives, disintegration aids, antioxidants, humectants, and preservatives. See, for example, those representative components, combination of components, relative amounts of those components and ingredients relative to tobacco, and manners and methods for employing those components, set forth in U.S. Pat. No. 9,237,769 to Mua et al. and U.S. Pat. No. 7,861,728 to Holton, Jr. et al. and US Pat. App. Pub. No. 2007/0062549 to Holton, Jr. et al., each of which is incorporated herein by reference.

The relative amount of smoke-treated tobacco material within the smokeless tobacco product may vary. Preferably, the amount of smoke-treated tobacco material within the smokeless tobacco product is at least about 10%, at least about 25%, at least about 50%, at least about 60%, at least about 70%, at least about 80%, or at least about 90% on a dry weight basis of the formulation. A typical range of tobacco material within the formulation is about 10 to about 99%, more often about 50 to about 99% by weight on a dry basis.

Exemplary flavorants that can be used are components, or suitable combinations of those components, that act to alter the bitterness, sweetness, sourness, or saltiness of the smokeless tobacco product, enhance the perceived dryness or moistness of the formulation, or the degree of tobacco taste exhibited by the formulation. Flavorants may be natural or synthetic, and the character of the flavors imparted thereby may be described, without limitation, as fresh, sweet, herbal, confectionary, floral, fruity, or spicy. Specific types of flavors include, but are not limited to, vanilla, coffee, chocolate/cocoa, cream, mint, spearmint, menthol, peppermint, wintergreen, eucalyptus, lavender, cardamon, nutmeg, cinnamon, clove, cascarilla, sandalwood, honey, jasmine, ginger, anise, sage, licorice, lemon, orange, apple, peach, lime, cherry, strawberry, and any combinations thereof. See also, Leffingwell et al., Tobacco Flavoring for Smoking Products, R. J. Reynolds Tobacco Company (1972), which is incorporated herein by reference. Flavorings also may include components that are considered moistening, cooling or smoothening agents, such as eucalyptus. These flavors may be provided neat (i.e., alone) or in a composite (e.g., spearmint and menthol, or orange and cinnamon). Representative types of components also are set forth in U.S. Pat. No. 5,387,416 to White et al.; US Pat. App. Pub. No. 2005/0244521 to Strickland et al.; and PCT Application Pub. No. WO 05/041699 to Quinter et al., each of which is incorporated herein by reference. Types of flavorants include salts (e.g., sodium chloride, potassium chloride, sodium citrate, potassium citrate, sodium acetate, potassium acetate, and the like), natural sweeteners (e.g., fructose, sucrose, glucose, maltose, mannose, galactose, lactose, and the like), artificial sweeteners (e.g., sucralose, saccharin, aspartame, acesulfame K, neotame, and the like); and mixtures thereof. The amount of flavorants utilized in the tobacco composition can vary, but is typically up to about 10 dry weight percent, and certain embodiments are characterized by a flavorant content of at least about 1 dry weight percent, such as about 1 to about 10 dry weight percent. Combinations of flavorants are often used, such as about 0.1 to about 2 dry weight percent of an artificial sweetener, about 0.5 to about 8 dry weight percent of a salt such as sodium chloride and about 1 to about 5 dry weight percent of an additional flavoring.

Exemplary filler materials include vegetable fiber materials such as sugar beet fiber materials (e.g., FIBREX® brand filler available from International Fiber Corporation), oats or other cereal grain (including processed or puffed grains), bran fibers, starch, or other modified or natural cellulosic materials such as microcrystalline cellulose. Additional specific examples include corn starch, maltodextrin, dextrose, calcium carbonate, calcium phosphate, lactose, manitol, xylitol, and sorbitol. The amount of filler, where utilized in the tobacco composition, can vary, but is typically up to about 20 dry weight percent, and certain embodiments are characterized by a filler content of up to about 10 dry weight percent, up to about 5 dry weight percent or up to about 1 dry weight percent. Combinations of fillers can also be used.

Typical binders can be organic or inorganic, or a combination thereof. Representative binders include povidone, sodium carboxymethylcellulose and other modified cellulosic materials, sodium alginate, xanthan gum, starch-based binders, gum arabic, pectin, carrageenan, pullulan, zein, and the like. The amount of binder utilized in the tobacco composition can vary, but is typically up to about 30 dry weight percent, and certain embodiments are characterized by a binder content of at least about 5 dry weight percent, such as about 5 to about 30 dry weight percent.

Preferred pH adjusters or buffering agents provide and/or buffer within a pH range of about 6 to about 10, and exemplary agents include metal hydroxides, metal carbonates, metal bicarbonates, and mixtures thereof. Specific exemplary materials include citric acid, sodium hydroxide, potassium hydroxide, potassium carbonate, sodium carbonate, and sodium bicarbonate. The amount of pH adjuster or buffering material utilized in the tobacco composition can vary, but is typically up to about 5 dry weight percent, and certain embodiments can be characterized by a pH adjuster/buffer content of less than about 0.5 dry weight percent, such as about 0.05 to about 0.2 dry weight percent. Particularly in embodiments comprising an extract clarified by distillation, the pH may be lowered by the addition of one or more pH adjusters (e.g., citric acid).

A colorant may be employed in amounts sufficient to provide the desired physical attributes to the tobacco formulation. Exemplary colorants include various dyes and pigments, such as caramel coloring and titanium dioxide. The amount of colorant utilized in the tobacco composition can vary, but is typically up to about 3 dry weight percent, and certain embodiments are characterized by a colorant content of at least about 0.1 dry weight percent, such as about 0.5 to about 3 dry weight percent.

Exemplary humectants include glycerin and propylene glycol. The amount of humectant utilized in the tobacco composition can vary, but is typically up to about 5 dry weight percent, and certain embodiments can be characterized by a humectant content of at least about 1 dry weight percent, such as about 2 to about 5 dry weight percent.

Other ingredients such as preservatives (e.g., potassium sorbate), disintegration aids (e.g., microcrystalline cellulose, croscarmellose sodium, crospovidone, sodium starch glycolate, pregelatinized corn starch, and the like), and/or antioxidants can also be used. Typically, such ingredients, where used, are used in amounts of up to about 10 dry weight percent and usually at least about 0.1 dry weight percent, such as about 0.5 to about 10 dry weight percent. A disintegration aid is generally employed in an amount sufficient to provide control of desired physical attributes of the tobacco formulation such as, for example, by providing loss of physical integrity and dispersion of the various component materials upon contact of the formulation with water (e.g., by undergoing swelling upon contact with water).

As noted, in some embodiments, any of the components described above can be added in an encapsulated form (e.g., in the form of microcapsules), the encapsulated form a wall or barrier structure defining an inner region and isolating the inner region permanently or temporarily from the tobacco composition. The inner region includes a payload of an additive either adapted for enhancing one or more sensory characteristics of the smokeless tobacco product, such as taste, mouthfeel, moistness, coolness/heat, and/or fragrance, or adapted for adding an additional functional quality to the smokeless tobacco product, such as addition of an antioxidant or immune system enhancing function. See, for example, the subject matter of U.S. Pat. No. 8,061,362 to Mua et al., which is incorporated herein by reference.

Representative tobacco formulations may incorporate about 80% to about 95% percent smoke-treated tobacco material, about 0.1% to about 5% artificial sweetener, about 0.5% to about 2% salt, about 1% to about 5% flavoring, about 1% to about 5% humectants (e.g., propylene glycol), and up to about 10% pH adjuster or buffering agent (e.g., sodium bicarbonate or citric acid), based on the total dry weight of the tobacco formulation. The particular percentages and choice of ingredients will vary depending upon the desired flavor, texture, and other characteristics.

The components of the tobacco composition can be brought together in admixture using any mixing technique or equipment known in the art. The optional components noted above, which may be in liquid or dry solid form, can be admixed with the smoke-treated tobacco material in a pretreatment step prior to mixture with any remaining components of the composition or simply mixed with the smoke-treated tobacco material together with all other liquid or dry ingredients. Any mixing method that brings the tobacco composition ingredients into intimate contact can be used. A mixing apparatus featuring an impeller or other structure capable of agitation is typically used. Exemplary mixing equipment includes casing drums, conditioning cylinders or drums, liquid spray apparatus, conical-type blenders, ribbon blenders, mixers available as FKM130, FKM600, FKM1200, FKM2000 and FKM3000 from Littleford Day, Inc., Plough Share types of mixer cylinders, and the like. As such, the overall mixture of various components with the smoke-treated tobacco material may be relatively uniform in nature. See also, for example, the types of methodologies set forth in U.S. Pat. No. 4,148,325 to Solomon et al.; U.S. Pat. No. 6,510,855 to Korte et al.; and U.S. Pat. No. 6,834,654 to Williams, each of which is incorporated herein by reference. Manners and methods for formulating snus-type tobacco formulations will be apparent to those skilled in the art of snus tobacco product production.

The moisture content of the smokeless tobacco product prior to use by a consumer of the formulation may vary. Typically, the moisture content of the product, as present within the pouch prior to insertion into the mouth of the user, is less than about 55 weight percent, generally is less than about 50 weight percent, and often is less than about 45 weight percent. For certain tobacco products, such as those incorporating snus-types of tobacco compositions, the moisture content may exceed 20 weight percent, and often may exceed 30 weight percent. For example, a representative snus-type product may possess a tobacco composition exhibiting a moisture content of about 20 weight percent to about 50 weight percent, preferably about 20 weight percent to about 40 weight percent.

The manner by which the moisture content of the formulation is controlled may vary. For example, the formulation may be subjected to thermal or convection heating. As a specific example, the formulation may be oven-dried, in warmed air at temperatures of about 40° C. to about 95° C., with a preferred temperature range of about 60° C. to about 80° C. for a length of time appropriate to attain the desired moisture content. Alternatively, tobacco formulations may be moistened using casing drums, conditioning cylinders or drums, liquid spray apparatus, ribbon blenders, or mixers. Most preferably, moist tobacco formulations, such as the types of tobacco formulations employed within snus types of products, are subjected to pasteurization or fermentation. Techniques for pasteurizing/heat treating and/or fermenting snus types of tobacco products will be apparent to those skilled in the art of snus product design and manufacture.

The acidity or alkalinity of the tobacco formulation, which is often characterized in terms of pH, can vary. Typically, the pH of that formulation is at least about 6.5, and preferably at least about 7.5. Typically, the pH of that formulation will not exceed about 9, and often will not exceed about 8.5. A representative tobacco formulation exhibits a pH of about 6.8 to about 8.2 (e.g., about 7.8). A representative technique for determining the pH of a tobacco formulation involves dispersing 5 g of that formulation in 100 ml of high performance liquid chromatography water, and measuring the pH of the resulting suspension/solution (e.g., with a pH meter).

In certain embodiments, the smoke-treated tobacco material and any other components noted above are combined within a moisture-permeable packet or pouch that acts as a container for use of the tobacco. The composition/construction of such packets or pouches, such as the container pouch 12 in the embodiment illustrated in FIG. 1, may be varied. Suitable packets, pouches or containers of the type used for the manufacture of smokeless tobacco products are available under the tradenames CatchDry, Ettan, General, Granit, Goteborgs Rape, Grovsnus White, Metropol Kaktus, Mocca Anis, Mocca Mint, Mocca Wintergreen, Kicks, Probe, Prince, Skruf and TreAnkrare. The tobacco formulation may be contained in pouches and packaged, in a manner and using the types of components used for the manufacture of conventional snus types of products. The pouch provides a liquid-permeable container of a type that may be considered to be similar in character to the mesh-like type of material that is used for the construction of a tea bag. Components of the loosely arranged, granular tobacco formulation readily diffuse through the pouch and into the mouth of the user.

Descriptions of various components of snus types of products and components thereof also are set forth in US Pat. App. Pub. No. 2004/0118422 to Lundin et al., which is incorporated herein by reference. See, also, for example, U.S. Pat. No. 4,607,479 to Linden; U.S. Pat. No. 4,631,899 to Nielsen; U.S. Pat. No. 5,346,734 to Wydick et al.; and U.S. Pat. No. 6,162,516 to Den, and US Pat. Pub. No. 2005/0061339 to Hansson et al.; each of which is incorporated herein by reference. See, also, the types of pouches set forth in U.S. Pat. No. 5,167,244 to Kjerstad, which is incorporated herein by reference. Snus types of products can be manufactured using equipment such as that available as SB 51-1/T, SBL 50 and SB 53-2/T from Merz Verpackungmaschinen GmBH. Snus pouches can be provided as individual pouches, or a plurality of pouches (e.g., 2, 4, 5, 10, 12, 15, 20, 25 or 30 pouches) can connected or linked together (e.g., in an end-to-end manner) such that a single pouch or individual portion can be readily removed for use from a one-piece strand or matrix of pouches.

An exemplary pouch may be manufactured from materials, and in such a manner, such that during use by the user, the pouch undergoes a controlled dispersion or dissolution. Such pouch materials may have the form of a mesh, screen, perforated paper, permeable fabric, or the like. For example, pouch material manufactured from a mesh-like form of rice paper, or perforated rice paper, may dissolve in the mouth of the user. As a result, the pouch and tobacco formulation each may undergo complete dispersion within the mouth of the user during normal conditions of use, and hence the pouch and tobacco formulation both may be ingested by the user. Other exemplary pouch materials may be manufactured using water dispersible film forming materials (e.g., binding agents such as alginates, carboxymethylcellulose, xanthan gum, pullulan, and the like), as well as those materials in combination with materials such as ground cellulosics (e.g., fine particle size wood pulp). Preferred pouch materials, though water dispersible or dissolvable, may be designed and manufactured such that under conditions of normal use, a significant amount of the tobacco formulation contents permeate through the pouch material prior to the time that the pouch undergoes loss of its physical integrity. If desired, flavoring ingredients, disintegration aids, and other desired components, may be incorporated within, or applied to, the pouch material.

The amount of material contained within each pouch may vary. In smaller embodiments, the dry weight of the material within each pouch is at least about 50 mg to about 150 mg. For a larger embodiment, the dry weight of the material within each pouch preferably does not exceed about 300 mg to about 500 mg. In some embodiments, each pouch/container may have disposed therein a flavor agent member, as described in greater detail in U.S. Pat. No. 7,861,728 to Holton, Jr. et al., which is incorporated herein by reference. If desired, other components can be contained within each pouch. For example, at least one flavored strip, piece or sheet of flavored water dispersible or water soluble material (e.g., a breath-freshening edible film type of material) may be disposed within each pouch along with or without at least one capsule. Such strips or sheets may be folded or crumpled in order to be readily incorporated within the pouch. See, for example, the types of materials and technologies set forth in U.S. Pat. No. 6,887,307 to Scott et al. and U.S. Pat. No. 6,923,981 to Leung et al.; and The EFSA Journal (2004) 85, 1-32; which are incorporated herein by reference.

The smokeless tobacco product can be packaged within any suitable inner packaging material and/or outer container. See also, for example, the various types of containers for smokeless types of products that are set forth in U.S. Pat. No. 7,014,039 to Henson et al.; U.S. Pat. No. 7,537,110 to Kutsch et al.; U.S. Pat. No. 7,584,843 to Kutsch et al.; U.S. Pat. No. 8,397,945 to Gelardi et al., U.S. Pat. No. D592,956 to Thiellier; U.S. Pat. No. D594,154 to Patel et al.; and U.S. Pat. No. D625,178 to Bailey et al.; US Pat. Pub. Nos. 2008/0173317 to Robinson et al.; 2009/0014343 to Clark et al.; 2009/0014450 to Bjorkholm; 2009/0250360 to Bellamah et al.; 2009/0266837 to Gelardi et al.; 2009/0223989 to Gelardi; 2009/0230003 to Thiellier; 2010/0084424 to Gelardi; and 2010/0133140 to Bailey et al; 2010/0264157 to Bailey et al.; and 2011/0168712 to Bailey et al. which are incorporated herein by reference.

Products of the present invention may be packaged and stored in much the same manner that conventional types of smokeless tobacco products are packaged and stored. For example, a plurality of packets or pouches may be contained in a cylindrical container. If desired, moist tobacco products (e.g., products having moisture contents of more than about 20 weight percent) may be refrigerated (e.g., at a temperature of less than about 10° C., often less than about 8° C., and sometimes less than about 5° C.). Alternatively, relatively dry tobacco products (e.g., products having moisture contents of less than about 15 weight percent) often may be stored under a relatively wide range of temperatures.

The smokeless tobacco products of the invention are advantageous in that they contain a tobacco composition that exhibits smoky flavor characteristics due to the disclosed treatment process, preferably without significant addition of extraneous flavorants/compounds to achieve such characteristics. Advantageously, the tobacco compositions with smoky flavor characteristics do not impart a significant amount of, e.g., benzo[a]pyrene or TSNAs to the smokeless tobacco products into which they are incorporated.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed:

1. A method of preparing a flavorful smokeless tobacco product, comprising:

(i) producing smoke from a wood material selected from oak, beech, alder, hickory, mesquite, acacia, ash, birch, pecan, walnut, almond, maple, olive, cottonwood, lilac, apple, crabapple, pear, cherry, plum, and combinations thereof, wherein the producing comprises applying friction to the wood material;

(ii) subjecting a tobacco material to the smoke to give a smoke-treated tobacco material with modified taste characteristics; and (iii) incorporating the smoke-treated tobacco material into a smokeless tobacco product.

2. The method of claim 1, wherein the tobacco material comprises solid tobacco material selected from the group consisting of lamina and stems.

3. The method of claim 1, wherein the tobacco material comprises cured tobacco material.

4. The method of claim 1, wherein the tobacco material comprises dark air cured tobacco.

5. The method of claim 1, further comprising curing the tobacco material, wherein the subjecting is done during the curing step.

6. The method of claim 1, wherein the subjecting is done at a temperature around 25° C. or below.

7. The method of claim 1, wherein the subjecting is done at a temperature around 25° C. or above.

8. The method of claim 1, further comprising mixing the smoke-treated tobacco material with a second tobacco material prior to the incorporating step.

9. The method of claim 8, wherein the second tobacco material is not a smoke-treated tobacco material.

10. The method of claim 1, further comprising grinding the smoke-treated tobacco material so as to provide it in particulate form.

11. The method of claim 1, wherein the smokeless tobacco product further comprises one or more additional components selected from the group consisting of flavorants, fillers, binders, pH adjusters, buffering agents, colorants, disintegration aids, antioxidants, humectants, and preservatives.

12. The method of claim 1, wherein the smokeless tobacco product is in the form of moist snuff.

13. The method of claim 1, wherein the smokeless tobacco product comprises the smoke-treated tobacco material contained within a sealed pouch.

14. The method of claim 1, wherein the smoke-treated tobacco material has a lower concentration of benzo(a) pyrene than that present in a comparable amount of dark fire cured tobacco that has not been subjected to step (ii).

15. A method of preparing a flavorful smokeless tobacco product, comprising:

(i) subjecting a tobacco material to smoke to give a smoke-treated tobacco material with modified taste characteristics, wherein the subjecting comprises atomizing or vaporizing liquid smoke; and (ii) incorporating the smoke-treated tobacco material into a smokeless tobacco product.

16. The method of claim 15, wherein the tobacco material comprises dark air cured tobacco.

17. A method of preparing a flavorful smokeless tobacco product, comprising:

(i) subjecting a tobacco material to smoke to give a smoke-treated tobacco material with modified taste characteristics;

(ii) fermenting the smoke-treated tobacco material, wherein the subjecting is done during the fermenting step; and (iii) incorporating the fermented smoke-treated tobacco material into a smokeless tobacco product.

18. The method of claim 17, wherein the tobacco material comprises dark air cured tobacco.

* * * * *